US005125807A

United States Patent [19]

Kohler et al.

[11] Patent Number: 5,125,807

[45] Date of Patent: Jun. 30, 1992

[54] FUEL INJECTION DEVICE

[75] Inventors: Wolfgang Kohler; Reda Rizk, both of Cologne; Hans-Gottfried Michels, Erftstadt, all of Fed. Rep. of Germany

[73] Assignee: Kloeckner-Humboldt-Deutz AG, Cologne, Fed. Rep. of Germany

[21] Appl. No.: 502,765

[22] Filed: Apr. 2, 1990

[30] Foreign Application Priority Data

Apr. 4, 1989 [DE] Fed. Rep. of Germany ..... 3910793

[51] Int. Cl.[5] ..... F04B 39/10

[52] U.S. Cl. ..... 417/490; 123/458; 123/506; 251/129.16; 417/440

[58] Field of Search ..... 417/440, 490, 415, 307; 123/506, 458, 500; 137/454.2; 251/50, 129.16, 367

[56] References Cited

U.S. PATENT DOCUMENTS

| | | | |
|---|---|---|---|
| 2,700,397 | 1/1955 | Compton | 417/440 |
| 3,701,366 | 10/1972 | Tirelli et al. | 251/50 |
| 3,779,225 | 12/1973 | Watson et al. | 123/506 |
| 4,445,484 | 5/1984 | Marion | 123/506 |
| 4,616,675 | 10/1986 | Amrhein | 251/50 |
| 4,619,239 | 10/1986 | Wallenfang | 123/506 |
| 4,785,787 | 11/1988 | Riszk et al. | 123/506 |
| 4,840,162 | 6/1989 | Brunel | 123/506 |
| 4,971,116 | 11/1990 | Suzuki et al. | 251/129.16 |
| 4,988,967 | 1/1991 | Miller et al. | 251/129.16 |

*Primary Examiner*—Richard A. Bertsch
*Assistant Examiner*—Michael I. Kocharov
*Attorney, Agent, or Firm*—Charles L. Schwab

[57] ABSTRACT

A fuel injection device for diesel engines, having at least one pump plunger (4), which is sealingly guided in a plunger bushing (5) and forms, together with said plunger bushing (5), a high-pressure space (11) that is connected to a low-pressure space (13) by means of a control element during the downward motion of the fuel pump plunger, said high-pressure space (11) being placed in free flow communication with an injection valve (49) via an injection line 48. The use of a continuously open flow connection between the high-pressure space 11 and the injection valve 49 minimizes dead space thereby permitting development of high injection pressures.

7 Claims, 3 Drawing Sheets

FUEL INJECTION DEVICE

CROSS REFERENCE TO RELATED APPLICATION

Reference is made to a copending patent application Ser. No. 07/447,683 filed Dec. 8, 1989 by Reda Rizk and HansGottfried Michels for a Unit Fuel Injector disclosing some features shown in this application.

TECHNICAL FIELD

This invention relates to a fuel injection device for diesel engines.

PRIOR ART STATEMENT

Fuel injection pumps of this design type can draw in fuel via a suction hole in the plunger bushing and/or via a suction valve located in the region of the delivery space.

In another design type of fuel injection pumps, the fuel is drawn in via a seat valve arranged in the region of the high-pressure space and actuated by means of an electromagnetic adjusting device.

In both design types, after drawing in, the fuel is delivered by the pump plunger into the injection line via a delivery or relief valve.

The delivery or relief valve has the purpose of lowering the pressure in the injection line to a certain degree after the termination of the injection process and preventing the injection line from being sucked empty on the next drawing in of fuel. Both rapid closing of the injection valve with no after-injection and cavitation-free operation of the injection system are to be effected by this means.

British patent application publication GB 2079382 shows a sliding spool valve for controlling flow of low pressure fuel to the pump pressure chamber and for connecting the high pressure delivery passage to the low pressure fuel source to terminate injection.

OBJECTS AND BRIEF SUMMARY OF THE INVENTION

It is the object of the invention to improve fuel injection and thus combustion in diesel engines. Furthermore, the maintenance expense is to be kept low and the dimensions and costs kept small by means of the simple design of the fuel injection device.

The inventors have made a surprising discovery. Namely, that a delivery or relief valve can be dispensed with if a continuous flow connection exists between the high-pressure space and the low-pressure space in the time interval between the end of delivery and the onset of delivery. Thus, the pressure in the high-pressure region is relieved into the low-pressure space without any need for a delivery or relief valve. Since the high-pressure region is at the pressure of the low-pressure space in the time interval between the end of delivery and the onset of delivery, void formation in the high-pressure region due to the downward motion of the pump plunger is positively prevented. Due to the absence of the delivery or relief valve, the dead space is substantially reduced, since now a constant or roughly constant flow cross section can be realized between the delivery space and the injection valve. In this manner, the rigidity of the high-pressure system is enhanced so that, for equal delivery rates of the injection pump, higher injection pressures can be attained. Higher injection pressures, moreover, lead to improved combustion with low fuel consumption and low pollutant emission.

Additionally, the elimination of the delivery valve provides a simplification and cost reduction of the injection unit. Furthermore, the useful life and the expense of maintaining the injection device are reduced by means of the elimination of a part subject to wear.

By means of the use of a seat valve with an electromagnetic adjusting device as a control element in accordance with the invention, and on the basis of the short response time of said control element, a more rapid pressure relief of the high-pressure region is achieved than in the usual mechanical control-edge system, especially as the pressure-relief volume is substantially reduced by means of the elimination of the relief valve. Because the switching time of the electromagnetic actuating device is constant over time and independent of speed, this advantage manifests itself particularly at low motor speeds.

By means of the position and arrangement of the seat valve in accordance with the invention, the dead space is likewise kept small since, despite the electromagnetically actuated seat valve built into the flow connection, said flow connection between the high-pressure space and the injection valve exhibits a virtually constant flow cross section. This is made possible because an annular high-pressure space is also provided, as a bypass line with constant flow cross section, in the region of the electromagnetically actuated seat valve.

In the approach in accordance with the invention, the high-pressure region is pressurized, during drawing in, with the inlet pressure prevailing in the low-pressure space. This so-called steady pressure, the level of which is guaranteed in accordance with the invention by a pressurizing valve in the suction space, insures in an advantageous fashion the stability of the onset of delivery and the quantity delivered by the injection pump and reduces the cavitation danger in the system.

The approach in accordance with the invention offers, in a further development, the advantage that the arrangement of the injection elements can be optimally adapted to the design peculiarities of the motor housing in each case.

By means of an advantageous development of the invention, the fuel injection pump is prevented from running dry with the motor stopped since, in accordance with the invention, a tightly closing supply valve closes off the low-pressure space from the fuel supply.

The approach in accordance with the invention offers, in a further development, the advantage that the arrangement of the injection pump elements can be optimally adapted to the design peculiarities of the motor housing in each case.

By means of an advantageous development of the invention, the injection line becomes especially short and thus the dead space especially small so that the injection pressure can become especially high.

By means of an advantageous development of the invention, separate fabrication and testing and individual replacement of the injection pump element and the control valve or the electromagnetic actuating device are made possible.

By means of an advantageous development of the invention, a reduction in the dead space of the fuel injection device is achieved.

For unrestricted exchangeability of the control valve, it is important to provide some clearance between the stepped hole in the injection pump element and the control valve.

The assembly clearance is bridged over in an advantageous fashion by means of two seal elements which, besides their high-pressure sealing function, provide a support for the control valve in the stepped hole of the plunger bushing.

By means of this invention, the high-pressure fuel, when it is spilled by the control valve body, is led through a hole in the plunger bushing back to the low-pressure space. Expensive external connecting lines with their danger of leakage are thus avoided.

A further advantageous development of the invention is the arrangement, parallel to the axis of the control valve body, of the elements with which the control valve is fastened to the plunger bushing. This arrangement prevents distortion and thus seizing of the control valve body in the control valve bushing.

By means of a spill groove in the pump plunger, the delivery of the injection pump is interrupted, independently of the operability of the control valve, before the delivery runs into the dome radius of the injection pump cam.

By means of the arrangement of the anchor plate in a vented and fuel-filled space in accordance with the invention, recoilless closing and thus exact control of the beginning of fuel delivery and quantity of fuel delivery is achieved, provided the clearance between the anchor in its picked-up state and the electromagnetic actuating device is adapted to the various design parameters of the control valve.

An advantageous development of the invention, namely a longitudinal and transverse leakage oil hole in the control valve body, avoids a separate leakage oil return line, the expense associated therewith, and the danger of leakage.

By means of the embodiment of the exterior outline of the injection pump element in accordance with the invention, replacement of a standard element by the injection pump element with control valve is possible without any reworking.

The position of the high-pressure space and the suction or spill hole in accordance with the invention makes possible a minimal dead space in the high-pressure region, which is comparable with the dead space of a standard element.

BRIEF DESCRIPTION OF THE DRAWINGS

Other features of the invention are derived from the description that follows and from the drawings, in which exemplary embodiments of the invention are illustrated schematically.

DETAILED DESCRIPTION OF THE DRAWINGS

Figure 1:
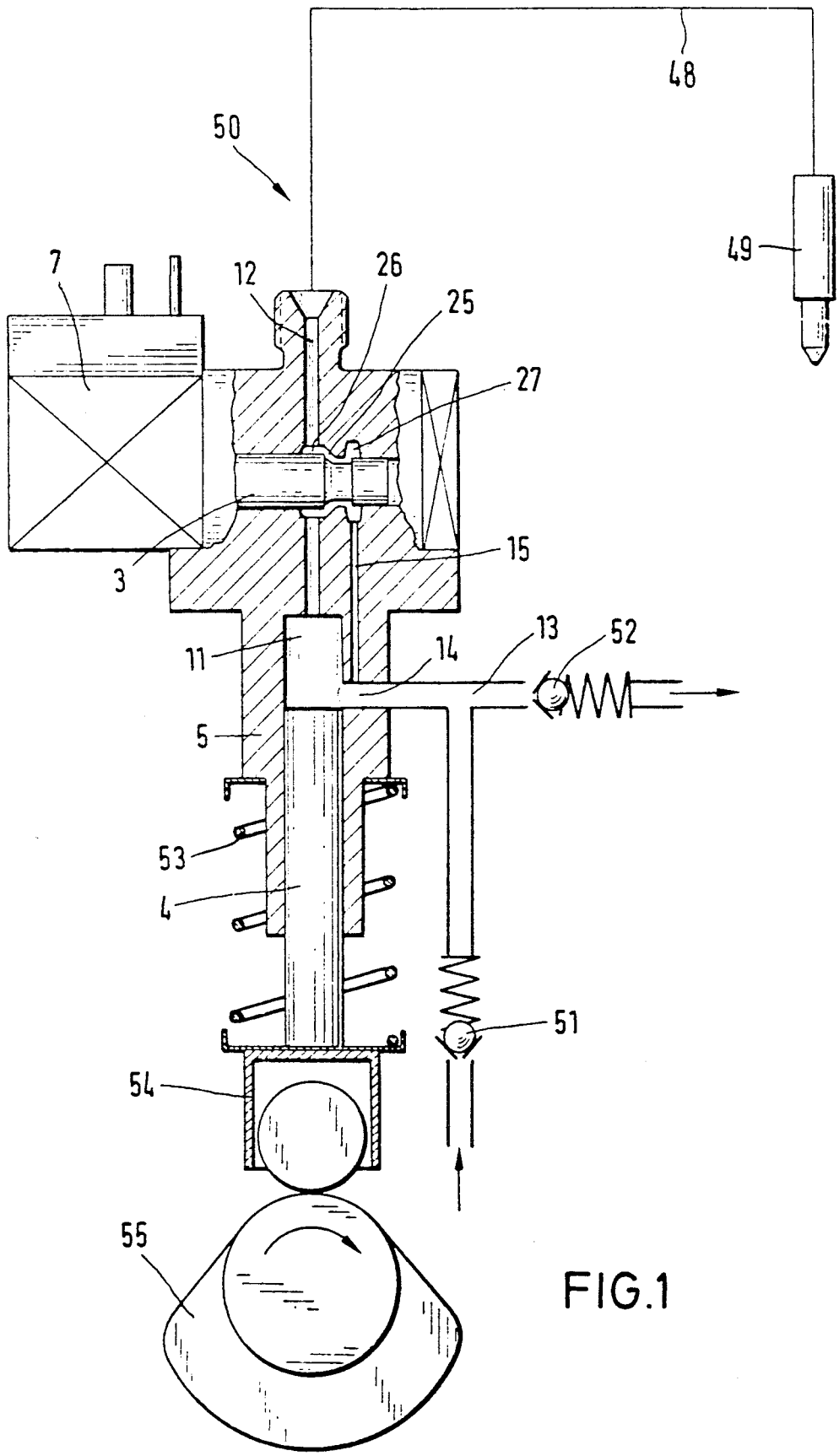
FIG. 1 shows a transverse section through a schematically illustrated injection pump with electromagnetically actuated control valve.
Figure 2:
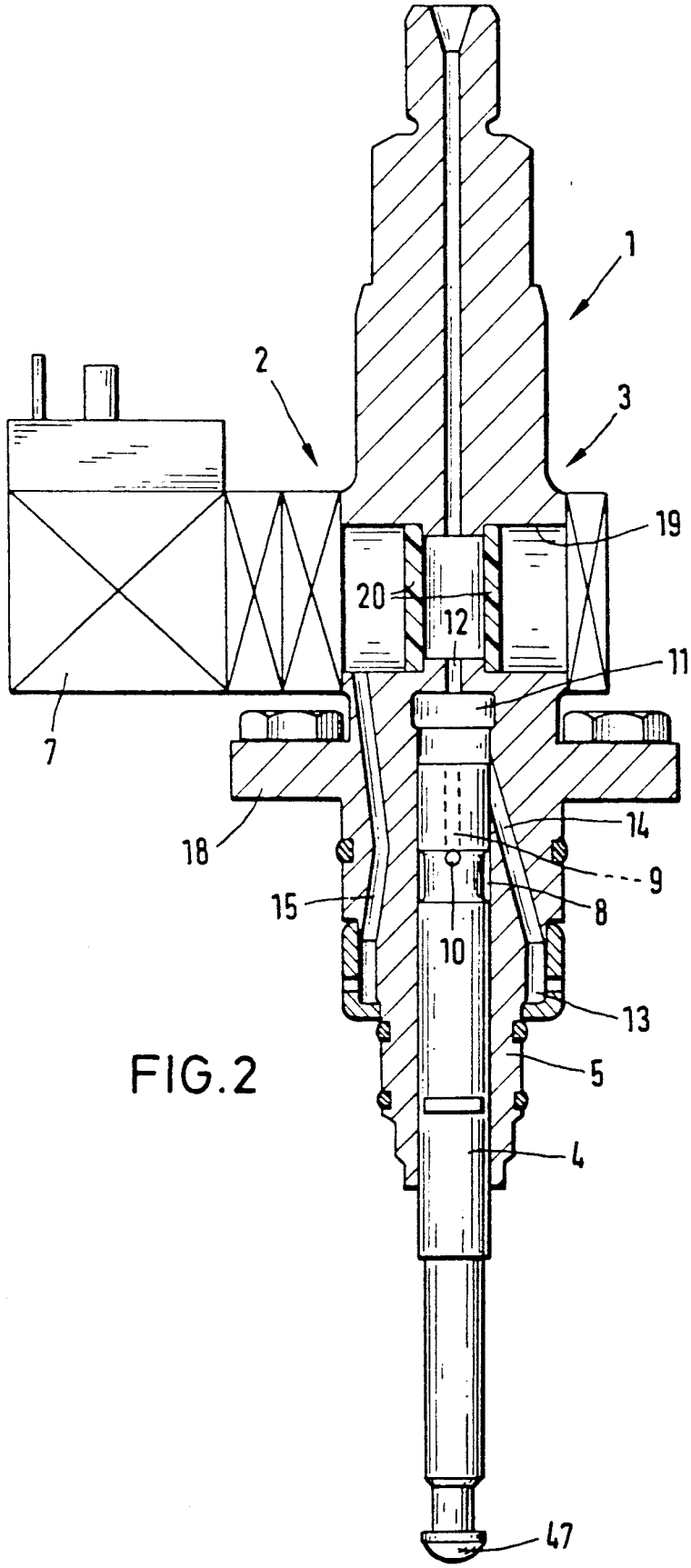
FIG. 2 shows a transverse section through the fuel injection device.
Figure 3:
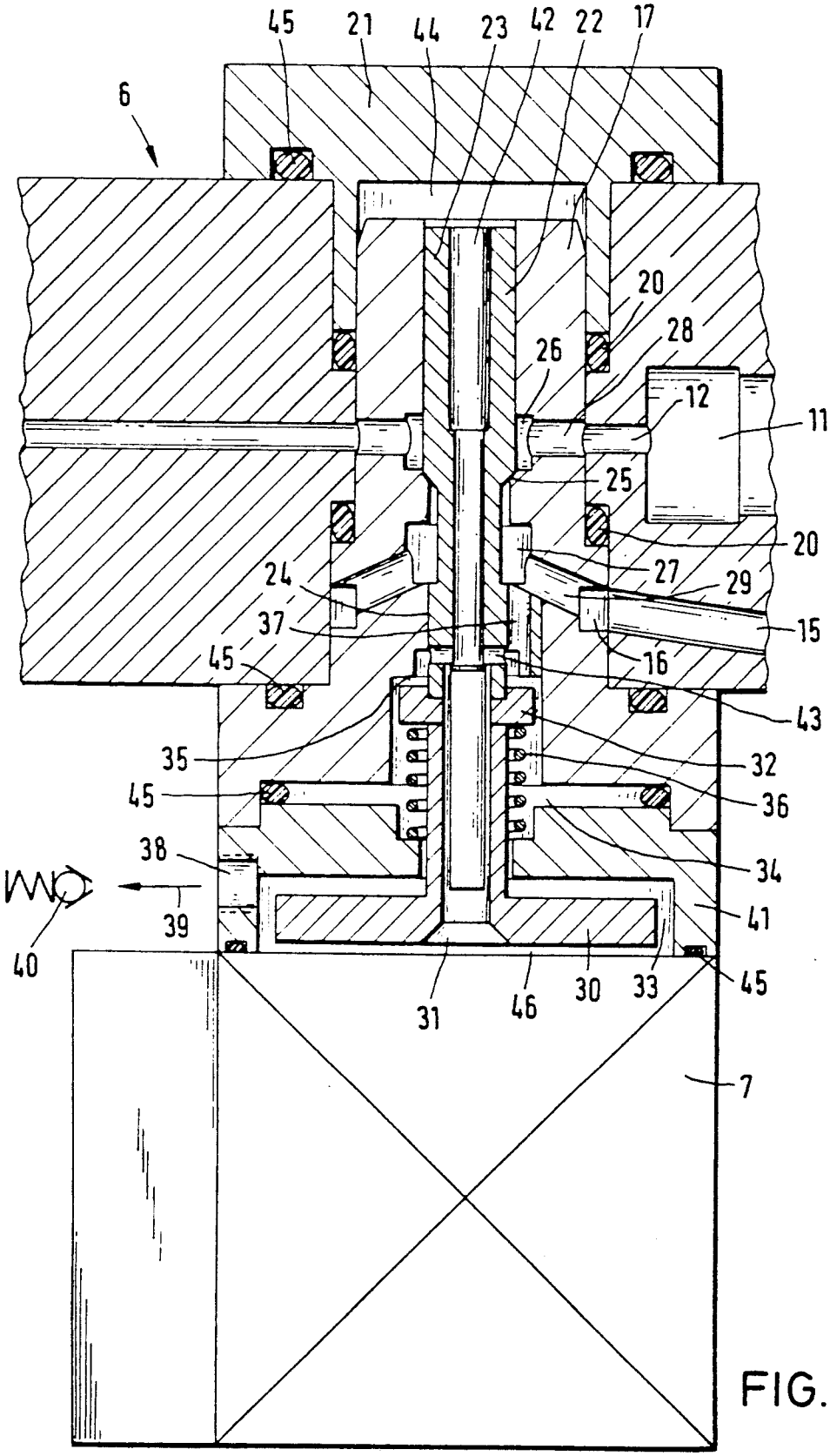
FIG. 3 shows a detailed section through the fuel injection device.

The fuel injection device consists of an injection pump element 1 and a control valve 2, the injection pump element 1 simultaneously being the carrier of the control valve 2. The injection pump element is assembled from a pump plunger 4 and a plunger bushing 5 and the control valve 2 from a seat valve 3 and an electromagnetic actuating device 7.

The pump plunger 4, which is sealingly guided in a bore of a plunger bushing 5, forms together therewith a high-pressure space 11 at the upper closed end of the bore. The pump plunger 4 has a spill groove 8, which is connected to a high-pressure space 11 via a longitudinal spill hole 9 and a transverse spill hole 10. When the plunger 4 is located at bottom dead center, the high-pressure space 11 is connected to the low-pressure space 13 via a suction or spill hole 14. The low-pressure space 13 is pressurized by a fuel delivery pump, not illustrated, via a supply line 51. The pressure in the low-pressure space 13 is held constant by a pressurizing valve 52.

The plunger 4 is moved axially against the force of a compression spring 53 by a cam 55 via a roller shaft 54. By this means, the fuel is delivered into a high-pressure hole 12 after the closing of the suction or spill hole 14. As long as the seat valve 3 is open, the delivered fuel flows back into the low-pressure space 13 via the annular high-pressure space 26, the control valve seat 25, the annular low-pressure space 27 and the return hole 15.

As soon as the seat valve 3 is closed by means of excitation (actuation) of the electromagnetic actuating device 7, high-pressure delivery begins, fuel being delivered to the injection valve 49 by means of the high-pressure hole 12, the annular high-pressure space 26 and the injection line 48.

The high-pressure space 11, the high-pressure hole 12 with annular high-pressure space 26, the injection line 48 and the injection valve 49 together form a high-pressure region 50.

High-pressure delivery is ended by means of opening of the seat valve 3. The connection thereby created to the low-pressure space 13 effects a pressure relief of the high-pressure region 50, which is at the pressure of the low-pressure space 13 until the closing again of the seat valve 3. By this means, void formation during the downward motion of the pump plunger is prevented and constant pressure conditions at the beginning of the next injection are insured, which constant pressure conditions lead to stable onset of delivery and quantitative characteristics.

The supply valve 51 and the pressurizing valve 52, which are made as especially tightly closing valves, prevent the low-pressure space 13 and the high-pressure region 50 from running dry with the motor stopped, by which means difficulties in the starting of the motor are avoided.

The high-pressure space 11 is carried up to a short distance below a stepped hole 19, which serves to accommodate the control valve 2. By this means, the dead space in the high-pressure space 11 is minimized, which proves especially advantageous at high injection pressures.

The high-pressure space 11 has no cover plate because the injection pump element 1 is embodied as a so-called "monoelement." The embodiment as a monoelement advantageously increases the high-pressure capability of the fuel injection device by minimizing the pressure space expansion.

In the plunger bushing 5 there is a suction or spill hole 14, which connects the high-pressure space 11 to a low-pressure space 13, which in turn is connected to the suction space, not illustrated, of the injection pump housing.

The suction or spill hole 14 is drilled from the low-pressure space 13 obliquely in the direction of the high-pressure space 11 in order to allow for the position of the high-pressure space 11.

The low-pressure space 13 is, furthermore, connected to an annular space 16 in a control valve bushing 17 of the seat valve 3 via a return hole 15. By this means, an external return line, with attendant construction expense and a leakage risk, in avoided.

The seat valve 3 sits with a clearance fit in the stepped hole 19 of the plunger bushing 5 and is supported in two high-pressure sealing elements 20. It is held in a firm connection with the plunger bushing 5 by means of screws, not illustrated, which are inserted through holes in a cover plate 21 and the plunger bushing 5 and screwed into the control valve bushing 17, without the seat valve 3 being distorted. Furthermore, distortion and consequently seizing of the seat valve 3 caused by the tightening of the injection line 48 is avoided by means of the assembly clearance between the control valve bushing 17 and the stepped hole 19.

A particular advantage of this arrangement consists in that independent replacement of control valve 2 and injection pump element 1, as well as the electromagnetic adjusting device 7, is assured. Low-cost fabrication and repair of the fuel injection device is possible by virtue of this modular construction.

The seat valve 3 has a control valve bushing 17 and a control valve body 22, which is axially movably guided in the control valve bushing 17, specifically in a high-pressure guide 23 and a low-pressure guide 24.

With a control valve seat 25, the control valve body 22 separates a high-pressure annular space 26 from a low-pressure annular space 27. The high-pressure annular space 26 is connected to the high-pressure space 11 via a high-pressure control hole 28 and the high-pressure hole 12. The low-pressure annular space 27 is connected to the low-pressure space 13 via the spill hole 29, the annular space 16 and the return hole 15.

The control valve body 22 has a longitudinal leakage oil hole 42 and a transverse leakage oil hole 43, which create a connection between a leakage oil space 44 and a spring space 34.

At the end of the control valve body 22 where the low-pressure guide 24 is located, there is attached an anchor plate 30, which is moved by the electromagnetic actuating device 7. The attachment of the anchor plate 30 is accomplished by means of a countersunk screw 31 screwed into the control valve body 22, which screw clamps the anchor plate 30 and a stop ring 32 axially against the control valve body 22.

The anchor plate 30 is located in a fuel-filled damping space 33, which is delimited by an intermediate piece 41 and the electromagnetic actuating device 7. The volume of the damping space 33 is sized such that, upon the axial movement of the anchor plate 30, no marked flow resistances occur between the anchor plate 30 and the walls of the intermediate piece 41.

The damping space 33 is connected to a spring space 34, likewise fuel-filled. In the spring space 34 there is a spring 36, whose force presses the stop ring 32 in the direction of the stop 35. The stop 35 serves to limit the stroke of the control valve body 22.

The damping space 33 and the spring space 34 are connected to the spill hole 29 via a choke hole 37.

In the region of the highest point of the damping space 33 in the installed position, there is made a tapped hole 38 to which a venting or fuel return line 39 is connected, which line leads to the fuel tank, not illustrated.

Arranged in this venting or fuel return line 39 is a pressurizing valve 40, whose spill pressure is lower than the delivery pressure of the fuel pump, not illustrated.

The electromagnetic actuating device 7 with the intermediate piece 41 is clamped against the control valve bushing 17 by means of screws, not illustrated, which act parallel to the axis of the control valve body 22, without distorting said control valve bushing.

The entire low-pressure region of the control valve 2 is sealed off by means of O-rings 45.

The fuel injection device functions in the following manner:

Upon the delivery stroke, the pump plunger 4 is moved from its bottom dead center position in the direction of the control valve 2. After running through a pre-stroke, it first closes the suction and spill hole 14. Afterward, the plunger 4 delivers fuel into the high-pressure hole 12 and into the high-pressure control hole 28.

As long as the control valve body 22 with the stop ring 32 and the anchor plate 30 is held against the stop 35 by the spring 36, the high-pressure annular space 26 and the low-pressure annular space 27 are connected via the control valve seat 25. Thereby the fuel delivered flows via the spill holes 29, the annular space 16 and the return hole 15 back into the low-pressure space 13.

As soon as the electromagnetic actuating device 7 is excited by a current pulse, the anchor plate 30 picked up, thereby pulling the control valve body 22 against the control valve seat nozzle 49 via the injection line 48.

Simultaneously with the picking up of the anchor plate 30, the spring 36 is prestressed. As soon as the electromagnetic actuating device 7 ceases to carry a current, the spring 36 lifts the control valve body 22 off its seat 25. Thus, the fuel again flows into the low-pressure spaces, and fuel injection is terminated.

A precondition for the precise functioning of the seat valve 3 and thus for reproducible onset of delivery and invariant quantity delivered, is the recoilless contact of the control valve body 22 on the control valve seat 25. This is achieved in accordance with the invention by means of a finely tuned damping of the movement of the control valve body 22. The displacement flow between the anchor plate 30 and the electromagnetic actuating device 7 is utilized for damping. The anchor plate is made with no open axial holes in order to bring about the most effective possible restricted flow between the anchor plate 30 and the electromagnetic actuating device 7 at the stroke end.

The requisite degree of damping depends on, among other factors, the moving mass, i.e., the mass of the control valve body 22 plus anchor plate 30 plus countersunk screw 31 plus stop ring 32 plus a portion of the mass of the spring 36. Another factor relevant to damping is the spring stiffness of the control valve seat 25.

The damping itself depends on, among other factors, the fuel viscosity, the geometry of the anchor plate 30 and the minimum spacing 46 between the anchor place 30 and the electromagnetic actuating device 7, as well as on the pressure in the damping space 33. These independent variables must be adapted to one another. The optimal adaptation is achieved when the contact of the control valve body 22 on the control valve seat 25 takes place without any recoil and the prolongation of the movement of the control valve body 22 due to damping is minimized.

The provision of the damping space 33 with damping liquid, for example damping oil, can be accomplished via a separate damping oil circuit. In the present case, in accordance with the invention, fuel is withdrawn from the low-pressure region, especially from the spill hole 29 of the seat valve 3, via the choke hole 37. The latter prevents pressure shocks in the spill hole 29 from reaching the damping space 33.

For proper functioning of the damping, it is important that there is no air in the damping space 33, since the viscosity and compressibility of the damping medium are influenced by such air. Furthermore, it is important that the damping liquid is continuously renewed, since said liquid becomes heated and ages.

In accordance with the invention, the venting of the damping space 33 is effected via the tapped hole 38, which is made in such a fashion that it is located in the region of the highest point of the damping space 33 in the installed position of the control valve 2.

Connected to the tapped hole 38 is the venting or fuel return line 39, by means of which the fuel flows via the pressurizing valve 40 back to the fuel tank, not illustrated. The pressurizing valve 40 insures a certain liquid pressure in the damping space 33, which pressure is lower than the maximum delivery pressure of the low-pressure pump, not illustrated, and is lower than the pressure in the low-pressure spaces of the fuel injection device. By this means, flow through the damping space 33 and thus renewal of the damping medium fuel and cooling of the control valve 2 is insured. In addition, the pressurizing valve 40 insures that the damping space 33 cannot run dry with the motor stopped, which leads to undamped stroke motion and thus to seat recoil of the control valve 3. This would result in, among other things, incorrect commencement of delivery upon restarting of the motor.

The leakage oil from the leakage oil space 44 is led, via the longitudinal leakage oil hole 42 and the transverse leakage oil hole 43 in the control valve body 22, to the spring space 34 and thus into the damping oil circuit. This approach in accordance with the invention saves a separate leakage oil return line.

For the case of a failure of the control valve 2, the spill groove 8 of the pump plunger 4 allows spilling of fuel into the suction or spill hole 14 at the end of the delivery stroke. Thus, fuel injection is terminated in every case before the delivery reaches the dome region of the injection pump cam and overloads it.

The pump plunger 4 of the injection pump element 1 is substantially easier to fabricate than a plunger of a standard fuel injection device having a rotatable spill control device with spill edges cooperating with plunger spill edges since the rotation device and the precise control edges become necessary.

The fuel injection device in accordance with the invention allows an exact determination of the onset of delivery and metering of the quantity of injected fuel by means of the recoilless contact of the control valve body 22 on the control valve seat 25. Furthermore, it is easy to fabricate and service, since the principal components, injection pump element 1, control valve 2 and electromagnetic adjusting device 7, can be fabricated, tested and replaced individually and independently of one another.

The embodiments of the invention in which an exclusive property or privilege is claimed are defined as follows:

1. A fuel injection device for diesel engines, comprising:

a fuel injection pump having a one piece plunger bushing (5), including a plunger bore with a first end which is open for receiving a plunger and a second end, a high pressure hole (12) in said plunger bushing (5) at said second end of said bore, said second end of said bore being closed except for said high pressure hole, a high pressure space (11) at said second end of said plunger bore, and wall means in said plunger bushing defining a stepped diameter bore, said stepped diameter bore extending transverse to and intersecting said high pressure hole closely adjacent to said high pressure space, a low pressure space (13) connected to said plunger bore at a substantial distance from said second end, a pump plunger (4) reciprocatably mounted in said plunger bore, a control valve bushing (17) having stepped diameter exterior surfaces in complimentary fitted relation with said stepped diameter bore in said plunger bushing, said control valve bushing having a stepped diameter interior bore including a large diameter portion and a small diameter portion and an axially facing sealing surface between said portions, a stepped diameter control valve body (22) having a large diameter portion and a small diameter portion in axial sliding engagement, respectively, with said stepped diameter interior bore of said control valve bushing and a control valve seat formed between said stepped diameter portions in axially confronting relation to said sealing surface, said control valve body being axially shiftable between a closed position in which said seat is in sealing engagement with said sealing surface and an open position in which said high pressure space is connected with said low pressure space, a return passage (15) interconnecting said small diameter portion of said stepped diameter bore with said low-pressure space (13), a spring operatively interposed between said control valve bushing (17) and control valve body (22) resiliently biasing the latter to its closed position wherein said seat engages said sealing surface, an injection valve (49) operable to inject fuel into an engine cylinder, a high-pressure fuel line (48) connecting said high pressure hole (12) with said injection valve (49), a liquid-filled damping space (33) at one axial end of said control valve bushing (17), an anchor polate (30) secured to an axial end of said control valve body (22) and disposed within said damping space (33), a choke hole (37) connecting said damping space (33) in free flow communication with said return passage (15), a venting line (39) connected to the highest point of said damping space (33), a pressurizing valve (40) connected to said venting line (39) having a relief pressure less than the pressure in said low-pressure space (13), and an electromagnetic actuating device operatively associated with said control valve body and selectively operative upon actuation to move said valve body to its open position in opposition to said spring.

said anchor plate and damping space, valve body, valve bushing, spring and choke hole being proportioned and arranged to effect a recoilless seating of said valve body seat on said sealing surface.

2. A fuel injection device for diesel engines, comprising:

a fuel injection pump having a one piece plunger bushing (5), including a plunger bore with a first end which is open for receiving a plunger and a second end, a high pressure hole (12) in said plunger bushing (5) at said second end of said bore, said second end of said bore being closed except for said high pressure hole, a high pressure space (11) at said second end of said plunger bore, and wall means in said plunger bushing defining a stepped diameter bore, said stepped diameter bore extending transverse to and intersecting said high pressure hole closely adjacent to said high pressure space;

a low pressure space (13) connected to said plunger bore at a substantial distance from said second end, a pump plunger (4) reciprocatably mounted in said plunger bore;

a control valve bushing (17) having stepped diameter exterior surfaces in complimentary fitted relation with said stepped diameter bore in said plunger bushing, said control valve bushing having a stepped diameter interior bore including a large diameter portion and a small diameter portion and an axially facing sealing surface between said portions, a stepped diameter control valve body (22) having a large diameter portion and a small diameter portion in axial sliding engagement, respectively, with said stepped diameter interior bore of said control valve bushing and a control valve seat formed between said stepped diameter portions in axially confronting relation to said sealing surface; said control valve body being axially shiftable between a closed position in which said seat is in sealing engagement with said sealing surface and an open position in which said high pressure space is connected with said low pressure space, a return passage (15) interconnecting said small diameter portion of said stepped diameter bore with said low-pressure space (13);

a spring operatively interposed between said control valve bushing (17) and control valve body (22) resiliently biasing the latter to its closed position wherein said seat engages said sealing surface;

an injection valve (49) operable to inject fuel into an engine cylinder;

a continuously open high-pressure fuel line (48) extending between and interconnecting said high pressure hole (12) with said injection valve (49), said high pressure hole (12) and said high pressure fuel line (48) forming a continuously open flow connection between said high pressure space (11) and said injection valve (49);

a liquid-filled damping space (33) at one axial end of said control valve bushing (17);

an anchor plate (30) secured to an axial end of said control valve body (22) and disposed within said damping space (33);

a choke hole (37) connecting said damping space (33) in free flow communication with said return passage (15);

a venting line (39) connected to the highest point of said damping space (33);

a pressurizing valve (40) connected to said venting line (39) having a relief pressure less than the pressure in said low-pressure space (13); and an electromagnetic actuating device operatively associated with said control valve body and selectively operative upon actuation to move said valve body to its open position in opposition to said spring;

said anchor plate and damping space, valve body, valve bushing, spring and choke hole being proportioned and arranged to effect a recoilless seating of said valve body seat on said sealing surface.

3. A fuel injection device for diesel engines, comprising:

a fuel injection pump having a one piece plunger bushing (5) including a plunger bore with a first end which is open for receiving a plunger and a second end, a high pressure hole (12) in said plunger bushing (5) connected to said second end of said bore, said second end of said bore being closed except for said high pressure hole (12), a high pressure space (11) at said second end of said plunger bore, a low pressure space connected to said plunger bore at a substantial distance from said second end, a stepped diameter bore having a large diameter portion and a small diameter portion, said stepped diameter bore extending transverse to and intersecting said high pressure hole closely adjacent to said high pressure space, and a return passage (15) interconnecting said small diameter portion of said stepped diameter bore with said low-pressure space, a pump plunger (4) reciprocatably mounted in said plunger bore, a seat valve including a control valve bushing (17) having stepped diameter exterior surfaces having a complementary fit with said stepped diameter bore in said plunger bushing, a stepped diameter interior bore having a large diameter portion and a small diameter portion with a seating surface therebetween and a high-pressure control hole (28) extending radially through said valve bushing in alignment with said high pressure hole (12), a stepped diameter cylindrical control valve body having a large diameter portion, a small diameter portion and a control valve seat formed between said large and small diameter portions, said large and small diameter portions being in axial sliding engagement with said stepped diameter interior bore of said control valve bushing, said control valve body being axially shiftable between a closed position in which said control valve seat sealingly engages said seating surface thereby preventing flow from said high-pressure hole (28) to said low-pressure space via said return passage and an open position in which flow from said high pressure hole to said low-pressure space is permitted, a spring operatively interposed between said control valve bushing and said control valve body resiliently biasing said control valve body axially toward its closed position, a liquid-filled damping space (33) in said control valve bushing and an anchor plate (30) secured to one of the axially opposite ends of said control valve body, said anchor plate (30) being operatively positioned in said damping space (33), seal elements (20) operable to seal said control valve bushing (17) in relation to said stepped diameter bore at opposite sides of said high-pressure control hole (28), an electromagnetic actuating device operatively associated with said control valve body and selectively operative upon actuation to move said body to its open position in opposition to said spring, a fuel supply passage connected to said low-pressure space, a check valve in said fuel supply passage operable only to admit fuel to said low-pressure space, a pressure relief valve connected to said low-pressure space operable to regulate the maximum fuel pressure in said low-pressure space, an injection valve (49) operable to inject fuel into an engine cylinder, and a continuously open high-pressure fuel line (48) extending between and interconnecting said high pressure hole (12) with said injection valve (49), said high pressure hole (12) and said high pressure fuel line (48) forming a continuously open flow connection of substantially uniform flow cross section between said high pressure space (11) and said injection valve (49).

4. The fuel injection device of claim 3 wherein said seat valve includes a choke hole (37) connecting said damping space (33) in free flow fuel communication with said return passage.

5. The fuel injection device of claim 4 and further comprising a venting line connected to the highest point of said damping space.

6. The fuel injection device of claim 5 and further comprising a pressurizing valve (40) is connected to said venting line (39), the relief pressure of said pressurizing valve being less than the pressure in said low-pressure space (13).

7. The fuel injection device of claim 6 wherein said anchor plate (30) is of a relatively large mass and predetermined geometry, wherein the moving parts of said seat valve are of a predetermined mass, said spring possesses a predetermined force and said fuel has a predetermined viscosity in operating temperature range of said engine, the force of the electromagnetic actuating device is a predetermined value and the clearance between the anchor plate (30) and the electromagnetic actuating device (7) in the non actuated condition of the latter is a predetermined distance whereby the contact of the stepped diameter cylindrical component on said control valve seat (25) is recoilless.

* * * * *